US007104305B1

(12) United States Patent
Apollon

(10) Patent No.: US 7,104,305 B1
(45) Date of Patent: Sep. 12, 2006

(54) VERTICALLY ADJUSTABLE ROD SUPPORT ASSEMBLY

(76) Inventor: Ghislaine F Apollon, 144-84 167th St., Springfield, NY (US) 11413

( * ) Notice: Subject to any disclaimer, the term of this patent is extended or adjusted under 35 U.S.C. 154(b) by 0 days.

(21) Appl. No.: 10/937,700

(22) Filed: Sep. 9, 2004

(51) Int. Cl.
*A47H 1/00* (2006.01)

(52) U.S. Cl. ..... 160/339

(58) Field of Classification Search ..... 160/333, 160/338, 339, 334, 335, 336, 337, 246, 247, 160/251, 253, 255, 256, 257, 258, 259, 260; 248/269, 270

See application file for complete search history.

(56) References Cited

U.S. PATENT DOCUMENTS 1,457,465 A * 6/1923 Sherwin ..... 160/259
1,655,336 A * 1/1928 Pippin ..... 160/260
2,229,898 A * 1/1941 Pastva ..... 248/257
2,461,417 A * 2/1949 Fallone ..... 211/103
2,565,280 A * 8/1951 Tapp ..... 211/103
2,576,171 A * 11/1951 Bratt ..... 211/105.2
2,910,121 A * 10/1959 Stern et al. ..... 160/125
3,120,895 A * 2/1964 Mahana et al. ..... 211/103
4,418,882 A 12/1983 Waring ..... 248/265
6,409,139 B1 6/2002 Du Pree ..... 248/354.1

* cited by examiner

*Primary Examiner*—David Purol
(74) *Attorney, Agent, or Firm*—Goldstein Law Offices PC.

(57) ABSTRACT

A vertically adjustable rod support assembly for selectively supporting an existing curtain rod and curtain at an elevated height within an existing window frame, and for enabling a user to lower the vertical height of the curtain rod in order to attach or detach the curtain from the rod, without the need for standing upon a ladder or another object. The vertically adjustable rod support assembly comprises two guide tracks, two pulley assemblies, and two selectively movable rod supports, each attached to a different pulley assembly. The rod supports are used for supporting the curtain rod. The pulley assemblies are used to selectively lower the rod supports, and thereby enables the user to lower the vertical height of the curtain rod supported thereupon, without the need for standing upon a ladder or another object.

4 Claims, 3 Drawing Sheets

VERTICALLY ADJUSTABLE ROD SUPPORT ASSEMBLY

BACKGROUND OF THE INVENTION

1. Field of the Invention

The invention generally relates to an apparatus for hanging a curtain rod, and in particular relates to a vertically adjustable rod support assembly for selectively supporting a curtain rod and curtain at an elevated height within a window frame, and for enabling a user to lower the vertical height of the curtain rod in order to attach or detach the curtain from the rod, without the need for standing upon a ladder or another object.

2. Description of the Related Art

Curtain rods, used for hanging curtains within an existing window having a window frame, add greatly to the aesthetic appeal of the window frame, and also provide the occupants of the room with a measure of privacy. However, curtain rods have a notable drawback. In particular, because a curtain rod is generally attached at a vertically elevated position within the window frame, an individual who wants to replace the curtain with one having a different design must ordinarily stand upon a ladder or another object in order to reach the curtain rod. The process of standing upon a ladder to reach a curtain rod in order to remove a curtain is an arduous one, and causes many thousands of accidents every year. Accordingly, there is a need for a vertically adjustable rod support assembly for selectively supporting a curtain rod and curtain at an elevated height within a window frame, and for enabling a user to lower the vertical height of the curtain rod in order to attach or detach the curtain from the rod, without the need for standing upon a ladder or another object.

A variety of adjustable height rod supporters have been devised. For example, U.S. Pat. No. 4,418,882 to Waring appears to show an adjustable height rod supporter comprising a first roller track containing a first guide roller, a second roller track containing a second guide roller, and a rod attachment bar secured to a first support shaft, for supporting a rod at various heights. Moreover, U.S. Pat. No. 6,409,139 B1 to Du Pree appears to show an adjustable height rod supporter which comprises a housing, a spring, an insert, and a cradle mounted on the insert, for providing vertical support to an existing rod.

While these devices may be suitable for the particular purpose employed, or for general use, they would not be as suitable for the purposes of the present invention as disclosed hereafter.

SUMMARY OF THE INVENTION

It is an object of the invention to provide a vertically adjustable rod support assembly for selectively supporting a curtain rod and curtain at an elevated height within a window frame, and for enabling a user to lower the curtain rod within the window frame, in order to attach or detach the curtain from the rod, without the need for standing upon a ladder. Accordingly, the vertically adjustable rod support assembly has two pulley assemblies, each having a selectively movable rod support attached thereunto. The rod supports are used for supporting the curtain rod. The pulley assemblies are used to selectively lower the rod supports and the curtain rod supported thereupon, and thereby enable the user to lower the curtain rod within the window frame, without the need for standing upon a ladder.

Further objects of the invention will become apparent in the detailed description of the invention that follows.

The invention is a vertically adjustable rod support assembly for selectively supporting an existing curtain rod and curtain at an elevated height within an existing window frame, and for enabling a user to lower the vertical height of the curtain rod in order to attach or detach the curtain from the rod, without the need for standing upon a ladder or another object. The vertically adjustable rod support assembly comprises two guide tracks, two pulley assemblies, and two selectively movable rod supports, each attached to a different pulley assembly. The rod supports are used for supporting the curtain rod. The pulley assemblies are used to selectively lower the rod supports, and thereby enables the user to lower the vertical height of the curtain rod supported thereupon, without the need for standing upon a ladder or another object.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
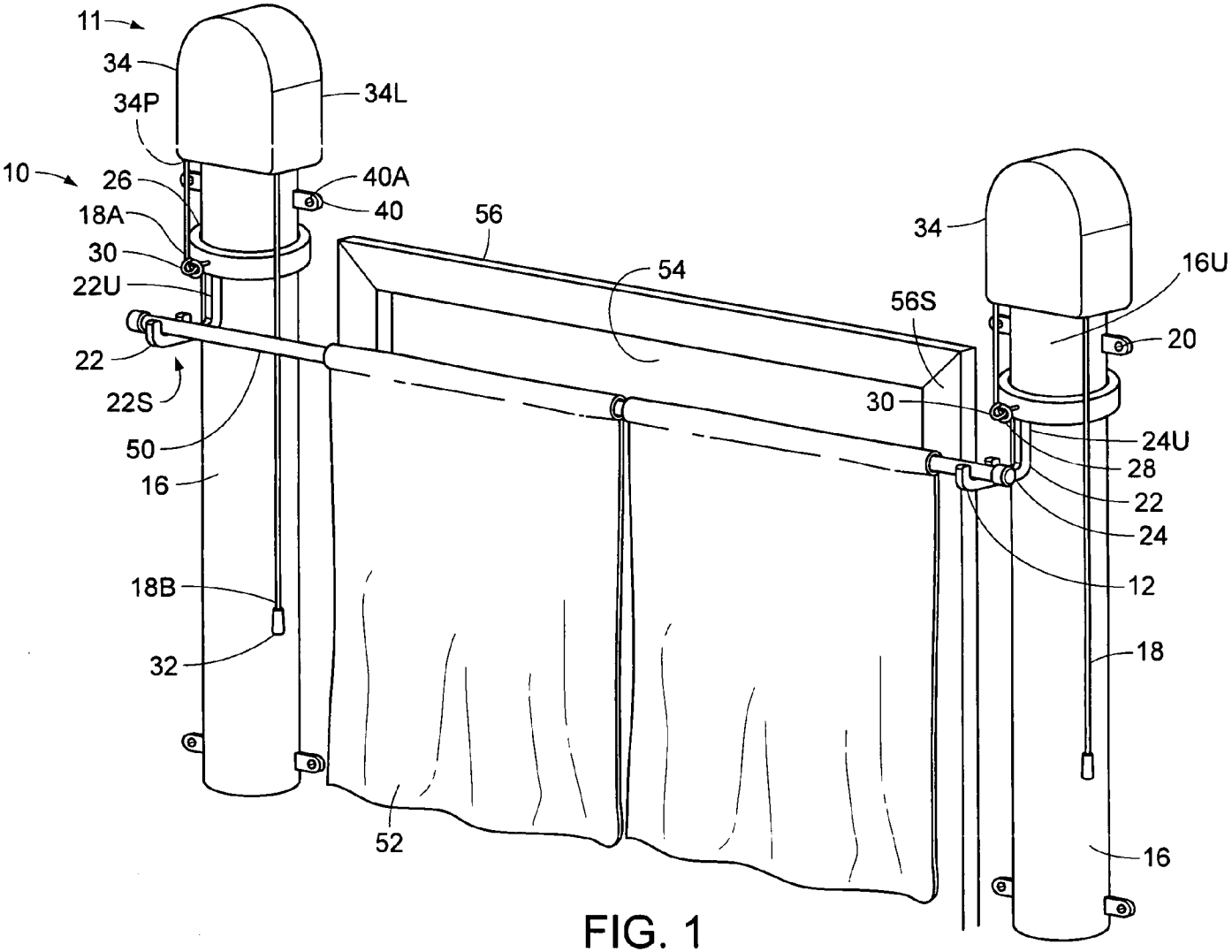
FIG. 1 is a perspective view of a vertically adjustable rod support assembly, after selective attachment to an existing window frame, wherein an existing curtain rod, having a curtain hanging vertically downward therefrom, is being supported thereupon, at a vertically elevated position within the window frame.

FIG. 1 illustrates a vertically adjustable rod support assembly 10, being used in conjunction with an existing window 54 having a window frame 56 having lateral sides 56S having an existing elongated curtain rod 50 extending therebetween, said curtain rod 50 having an existing curtain 52 hanging vertically downward therefrom. The curtain rod 50 is being selectively supported by the rod support assembly 10 at a vertically elevated position within the window frame 56. The rod support assembly 10 allows a user to selectively adjust the vertical height of the curtain rod 50 so that the user may attach or detach the curtain 52 therefrom without the need for standing upon a ladder or other object in order to be able to reach the curtain rod 50. The rod support assembly 10 comprises two substantially cylindrical guide tracks 16, each of which is selectively vertically mounted in proximity to a different one of the two lateral sides 56S of the window frame 56, and each having an upper end 16U and a lower end 16L. The upper end 16U of each of the guide tracks 16 has a pulley assembly 11 attached thereunto.

Figure 3:
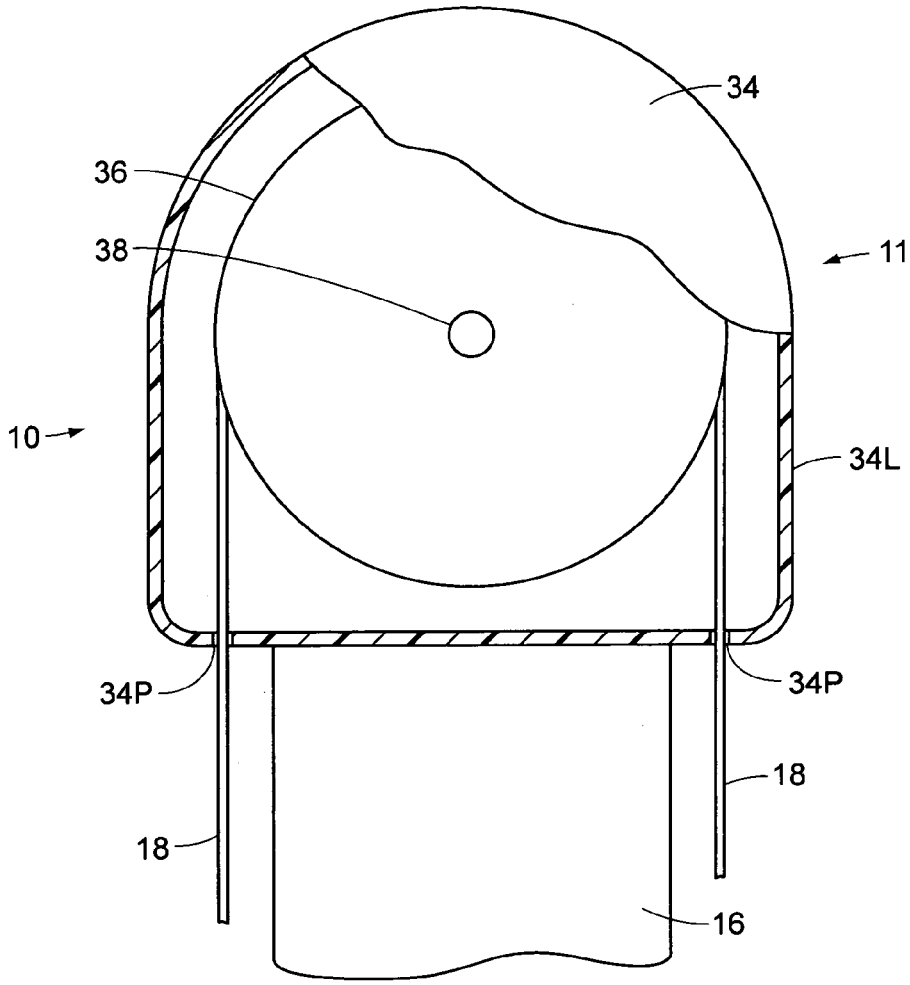
FIG. 3 is a front elevational view of a pulley wheel housing and a portion of an attached guide track, wherein a portion of the housing has been broken away to illustrate internal details thereof.

Turning to FIG. 3, each pulley assembly 11 comprises a pulley wheel housing 34 which encloses a selectively rotatable pulley wheel 36 having a grooved rim around its perimeter, an axle 38 which extends concentrically through the pulley wheel 36, and a nylon cord 18 which is looped over the grooved rim of the pulley wheel 36 and which selectively slides thereupon. The pulley wheel housing 34 has a lower end 34L which is affixed to and supported upon the upper end 16U of the guide track 16. The lower end 34L has two openings 34P extending fully therethrough, through which the cord 18 selectively extends. The cord 18 is preferably several feet long and has a first end 18A having a hook 30 attached thereunto, and has a second end 18B having a grasping handle 32 attached thereunto.

Returning to FIG. 1, the rod support assembly 10 further comprises two selectively movable curtain rod supports 12, for selectively supporting the elongated curtain rod 50 having a first end and a second end. Each rod support 12 comprises a vertical arm 22 and a horizontal arm 24. The horizontal arm 24 has an upper surface 24U having a vertical slot 22S for selectively supporting one of the ends of the curtain rod 50. The vertical arm 22 has an upper end 22U having a circular opening 28 extending therethrough. The hook 30 at the first end 18A of the nylon cord 18 extends through the circular opening 28 within the vertical arm 22, in order to attach the rod support 12 to the first end 18A of the nylon cord 18. When the user grasps and pulls downward upon the grasping handle 32 at the second end 18B of the nylon cord 18, this causes the hook 30 at the first end 18A of the nylon cord 18 to vertically raise, thereby also vertically raising the attached rod support 12, and thereby causing the curtain rod 50 resting upon the curtain rod supports 12 to also be selectively vertically raised. When the user releases the grasping handle 32 at the second end 18B of the nylon cord 18, this causes the hook 30 at the first end 18A of the nylon cord 18 to vertically lower, thereby also vertically lowering the attached rod support 12, and thereby causing the curtain rod 50 resting upon the curtain rod supports 12 to also be selectively vertically lowered. The movable rod supports 12 permit the user to selectively lower the curtain rod 50 so that the curtain 52 can be easily removed therefrom, without the need for climbing upon a ladder or another object. It is contemplated that the rod support assembly 10 may be provided with a cord locking mechanism for selectively immobilizing the cord 18, in order to selectively maintain the rod supports 12 at an elevated height.

The vertical arm 22 of each of the rod supports 12 has an attachment ring 26 extending therefrom. A different one of the two cylindrical guide tracks 16 extends concentrically through each of the two attachment rings 26. The attachment rings 26 selectively slide vertically upon the guide tracks 16 when the user pulls downward upon or releases the grasping handle 32 at the second end 18B of the nylon cord 18, while raising or lowering, respectively, the rod supports 12, and the curtain rod 50 selectively supported thereupon. The guide tracks 16 are used for stabilizing and constraining the lateral motion of the rod supports 12 as they selectively move vertically.

The cylindrical guide tracks 16 each have at least two attachment tabs 40 extending therefrom, for selectively attaching the guide tracks 16 to the lateral sides 56S of the window frame 56. Each of the tabs 40 has a circular opening 40A extending fully therethrough. The assembly 10 is provided with threaded mounting screws 20 for mounting the guide tracks 16 to the lateral sides 56S of the window frame 56. In particular, the user attaches the guide tracks 16 to the lateral sides 56S of the window frame 56 by extending a mounting screw 20 through each of the circular openings 40A of the tabs 40, and by threading the screws 20 into one of the lateral sides 56S of the window frame 56.

Figure 2:
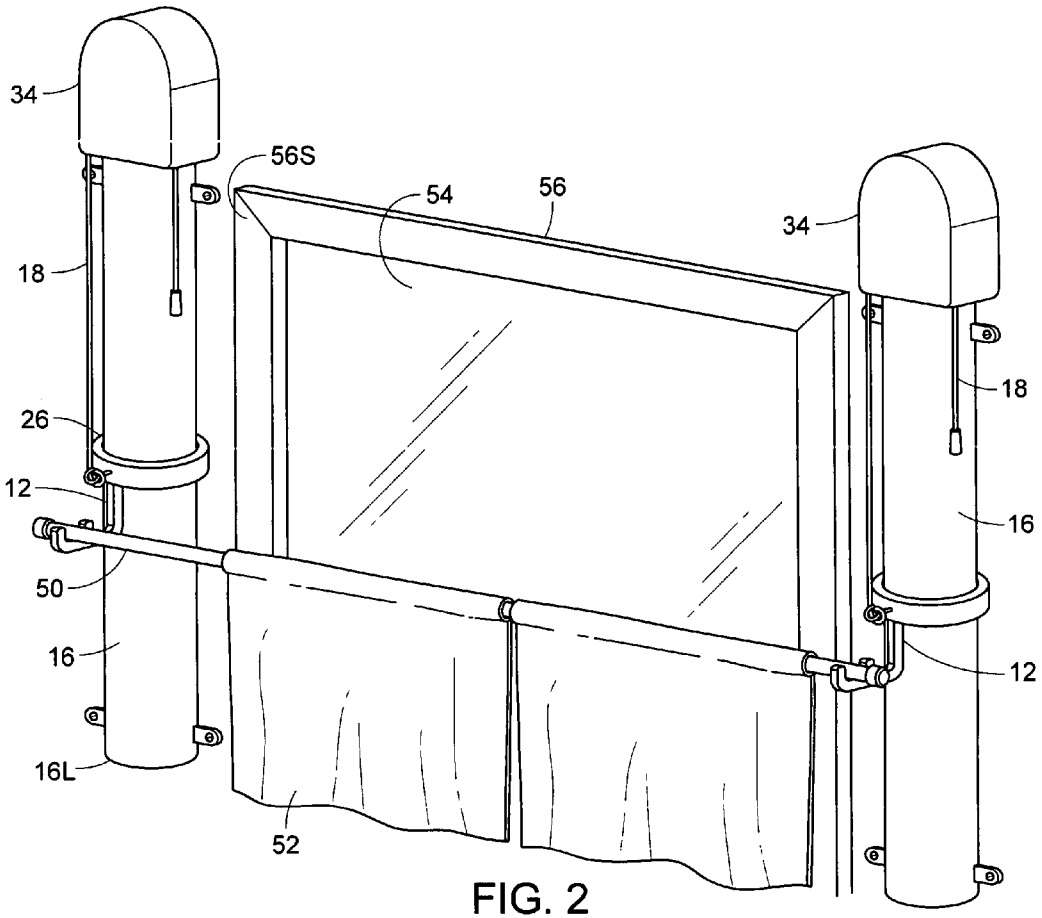
FIG. 2 is a perspective view of the vertically adjustable rod support assembly, as in FIG. 1, except that the curtain rod, and the curtain hanging vertically downward therefrom, have been vertically lowered within the window frame in order to allow a user to easily remove the curtain from the curtain rod.

FIG. 2 illustrates a view of the rod support assembly 10, as in FIG. 1, except that the curtain rod 50, and the curtain 52 hanging vertically downward therefrom, have been vertically lowered within the window frame 56 in order to allow the user to easily remove the curtain 52 from the curtain rod 50.

The components of the rod support assembly 10, with the exception of the cord 18, are preferably constructed from a durable metal. The rod support assembly 10 is provided in different sizes so that it may be suitably used with window frames 56 having lateral sides 56S having different lengths.

In use, the user vertically attaches the guide tracks 16 to the lateral sides 56S of an existing window frame 56 with the mounting screws 20 provided for this purpose. The user vertically lowers the attached rod supports 12. The user positions a curtain 52 upon an existing curtain rod 50. The user supports the curtain rod 50 within the vertical slot 22S of each of the rod supports 12. The user grasps and pulls downward upon the grasping handle 32 at the second end 18B of the nylon cord 18, in order to vertically raise the attached rod supports 12, and thereby causes the curtain rod 50 resting upon the curtain rod supports 12 to also be selectively vertically raised to an optimal position. When the user wants to remove the curtain 52 from the rod 50, the user releases the grasping handle 32 at the second end 18B of the nylon cord 18, thereby vertically lowering the attached rod supports 12, and thereby causing the curtain rod 50 resting upon the curtain rod supports 12 to also be selectively vertically lowered.

In conclusion, herein is presented a vertically adjustable rod support assembly for selectively supporting a curtain rod and curtain at an elevated height, and for enabling a user to lower the vertical height of the curtain rod in order to attach or detach the curtain from the rod, without the need for standing upon a ladder or another object. The invention is illustrated by example in the drawing figures, and throughout the written description. It should be understood that numerous variations are possible, while adhering to the inventive concept. Such variations are contemplated as being a part of the present invention.

What is claimed is:

1. A vertically adjustable rod support assembly, for use by a user in conjunction with an existing window having a window framing having lateral sides and having an existing elongated curtain rod having a first end, a second end, and an existing curtain which when selectively hangs vertically downward therefrom, said rod support assembly for selectively supporting the curtain rod and the curtain at an elevated height within the window frame, and for enabling the user to selectively lower the vertical height of the curtain rod within the window frame in order to attach or detach the curtain from the rod, without the need for standing upon an existing ladder, comprising:

two substantially cylindrical guide tracks, each of which is selectively mounted in proximity to a different one of the two lateral sides of the window frame, and each having an upper end and a lower end;

two pulley assemblies, each comprising a pulley wheel housing which enclosed a selectively rotatable pulley wheel having a grooved rim around its perimeter, an axle which extends concentrically through the pulley wheel, and a cord which is looped over the grooved rim of the pulley wheel, and a cord which is looped over the grooved rim of the pulley wheel and which selectively slides thereupon, said cord having a first end and a second end, said pulley wheel housing each affixed to and supported upon the upper end of a different guide track, said pulley wheel housings each having two openings extending fully therethrough, through which the cord selectively extends; and two selectively movable curtain rod supports, each comprising a vertical arm and a horizontal arm, wherein the horizontal arms each have an upper surface having a vertical slot for selectively supporting one of the ends of the curtain rod, wherein the vertical arms each have an upper end which is attached to the first end of the cord, wherein when the user grasps and pulls downward upon the second end of the cord, this causes the first end of the cord to vertically raise, thereby also vertically raising the attached rod support, and thereby causing the curtain rod resting upon the rod supports to also be selectively vertically raised, and wherein when the user releases the second end of the cord, this causes the first end of the cord to vertically lower, thereby also vertically lowering the attached rod support, and thereby causing the curtain rod resting upon the rod supports to also be selectively vertically lowered, said rod supports for allowing the user to selectively lower the curtain rod so that the curtain can be easily removed therefrom, without the need for climbing upon a ladder.

2. The rod support assembly as recited in claim 1, wherein the vertical arm of each of the rod supports has an attachment ring extending therefrom, wherein a different one of the two guide tracks extends concentrically through each of the two attachment rings, wherein the attachment rings selectively slide vertically upon the guide tracks when the user pulls downward upon or releases the second end of the cord, while raising or lowering respectively, the rod supports, and the curtain rod selectively supported thereupon, said guide tracks for stabilizing and constraining the lateral motion of the rod supports as they selectively move vertically.

3. The rod support assembly as recited in claim 2, wherein the guide tracks each have at least two attachment tabs extending therefrom, for selectively attaching the guide tracks to the lateral sides of the window frame, wherein each of the tabs has a circular opening extending fully therethrough, and where in the rod support assembly is provided with at least four threaded mounting screws, wherein the user attaches the guide tracks to the lateral sides of the window frame by extending a mounting screw through each of the circular openings of the tabs, and by threading the screws into one of the lateral sides of the window frame.

4. A method, for use by a user, for selectively supporting an existing elongated curtain rod at an elevated height within an existing window having a window frame having lateral sides, said curtain rod having an existing curtain which selectively hangs vertically downward therefrom, said method also for enabling the user to lower the vertical height of the curtain rod in order to attach or detach the curtain from the rod, without the need for standing upon an existing ladder, said method using a vertically adjustable rod support assembly having two cylindrical guide tracks, two pulley assemblies, each of said pulley assembly having a cord having a first end and a second end, said rod support assembly further having two selectively movable rod supports, each attached to a first end of a cord of a different pulley assembly, each of said rod supports having an attachment ring extending therefrom, wherein a different one of the two guide tracks extends concentrically through each of the two attachment rings, said method comprising the steps of:

vertically mounting the guide tracks by the user to the lateral sides of the window frame;

vertically lowering the rod supports by the user;

positioning the curtain upon the curtain rod by the user;

supporting the curtain rod upon each of the rod supports;

grasping and pulling downward by the user upon the second end of the cord, in order to vertically raise the attached rod supports, thereby causing the curtain rod resting upon the rod supports to also be selectively vertically raised within the window frame;

stabilizing and constraining the lateral motion of the rod supports as they selectively move vertically, by the guide tracks which extend concentrically through the attachment rings;

vertically lowering the rod supports by releasing the second end of the cord, and thereby causing the curtain rod resting upon the rod supports to also be selectively vertically lowered; and removing the curtain from the rod by the user.

* * * * *